US010487438B2

(12) United States Patent
Jung et al.

(10) Patent No.: US 10,487,438 B2
(45) Date of Patent: Nov. 26, 2019

(54) LAUNDRY TREATING APPARATUS AND METHOD FOR SUPPLYING WASHING AGENT THEREOF

(71) Applicant: LG ELECTRONICS INC., Seoul (KR)

(72) Inventors: Sungwoon Jung, Seoul (KR); Hunjun Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 229 days.

(21) Appl. No.: 15/392,013

(22) Filed: Dec. 28, 2016

(65) Prior Publication Data

US 2017/0191205 A1 Jul. 6, 2017

(30) Foreign Application Priority Data

Jan. 5, 2016 (KR) ..... 10-2016-0001210

(51) Int. Cl.
*D06F 39/02* (2006.01)
*D06F 39/08* (2006.01)

(52) U.S. Cl.
CPC ..... *D06F 39/022* (2013.01); *D06F 39/086* (2013.01); *D06F 2202/085* (2013.01);
(Continued)

(58) Field of Classification Search
CPC ..... D06F 39/02; D06F 39/022; D06F 2204/02
(Continued)

(56) References Cited

U.S. PATENT DOCUMENTS 7,093,500 B2 * 8/2006 Schulz ..... G01F 1/58 73/861.15
2009/0288453 A1 * 11/2009 Lee ..... D06F 39/022 68/17 R (Continued)

FOREIGN PATENT DOCUMENTS

CN 101886323 11/2010
CN 102197173 9/2011

(Continued)

OTHER PUBLICATIONS

European Search Report dated May 23, 2017 issued in Application No. 17150124.0.

(Continued)

*Primary Examiner* — Joseph L. Perrin
*Assistant Examiner* — Kevin G Lee
(74) *Attorney, Agent, or Firm* — Ked & Associates, LLP

(57) ABSTRACT

A laundry treating apparatus may include a washing agent supply unit supplying a liquid washing agent into a tub through a washing agent supply passage between a storage container and the tub, a residual quantity detecting unit to detect a residual quantity of the liquid washing agent, a laundry quantity detecting unit to detect a laundry quantity, and a controller controlling the washing agent supply unit to supply the liquid washing agent by adding a quantity of the liquid washing agent corresponding to the laundry quantity with a quantity of the liquid washing agent corresponding to the washing agent supply passage, when the liquid washing agent is initially supplied after detecting a residual quantity shortage of the washing agent, whereby an accurate quantity of the liquid washing agent can be supplied upon an initial supply after the detection of the residual quantity shortage.

13 Claims, 12 Drawing Sheets

(52) U.S. Cl.
CPC ..... *D06F 2202/10* (2013.01); *D06F 2204/02* (2013.01); *D06F 2212/02* (2013.01)

(58) Field of Classification Search
USPC ..... 68/17 R
See application file for complete search history.

(56) References Cited

U.S. PATENT DOCUMENTS

| | | | | |
|---|---|---|---|---|
| 2010/0101030 | A1 | 4/2010 | Kim | |
| 2010/0139010 | A1* | 6/2010 | Lee | D06F 39/022 8/159 |
| 2012/0006077 | A1 | 1/2012 | Mun et al. | |
| 2017/0037559 | A1* | 2/2017 | Gallagher | D06F 39/022 |

FOREIGN PATENT DOCUMENTS

| | | | | |
|---|---|---|---|---|
| CN | 102953256 | | 3/2013 | |
| EP | 2 405 052 | | 1/2012 | |
| EP | 2671995 | A1 * | 12/2013 | D06F 37/225 |
| EP | 2 708 633 | | 3/2014 | |
| EP | 2733249 | A2 * | 5/2014 | D06F 39/02 |
| JP | 07-039677 | | 2/1995 | |
| KR | 10-2010-0047625 | | 5/2010 | |
| KR | 10-2012-0004208 | | 1/2012 | |
| KR | 10-1482109 | | 1/2015 | |
| KR | 10-2015-0103988 | | 9/2015 | |
| WO | WO 2015/133799 | | 9/2015 | |

OTHER PUBLICATIONS

International Search Report dated Jan. 6, 2017 issued in Application No. PCT/KR2016/012811.
Chinese Office Action dated Sep. 17, 2018 issued in Application No. 201611165448.4. (English Translation Attached).
Russian Notice of Allowance (with English translation) dated Mar. 26, 2019 issued in RU Application No. 2018128284.

* cited by examiner

LAUNDRY TREATING APPARATUS AND METHOD FOR SUPPLYING WASHING AGENT THEREOF

CROSS-REFERENCE TO RELATED APPLICATION(S)

Pursuant to 35 U.S.C. § 119(a), this application claims the benefit of an earlier filing date of and the right of priority to Korean Application No. 10-2016-0001210, filed on Jan. 5, 2016, the contents of which are incorporated by reference herein in its entirety.

BACKGROUND

1. Field

Provided is a laundry treating apparatus and a method for supplying a washing agent thereof.

2. Background

Laundry treating apparatuses and methods for supplying washing agent are known. However, they suffer from various disadvantages.

BRIEF DESCRIPTION OF THE DRAWINGS

The embodiments will be described in detail with reference to the following drawings in which like reference numerals refer to like elements wherein.

DETAILED DESCRIPTION

Figure 1:
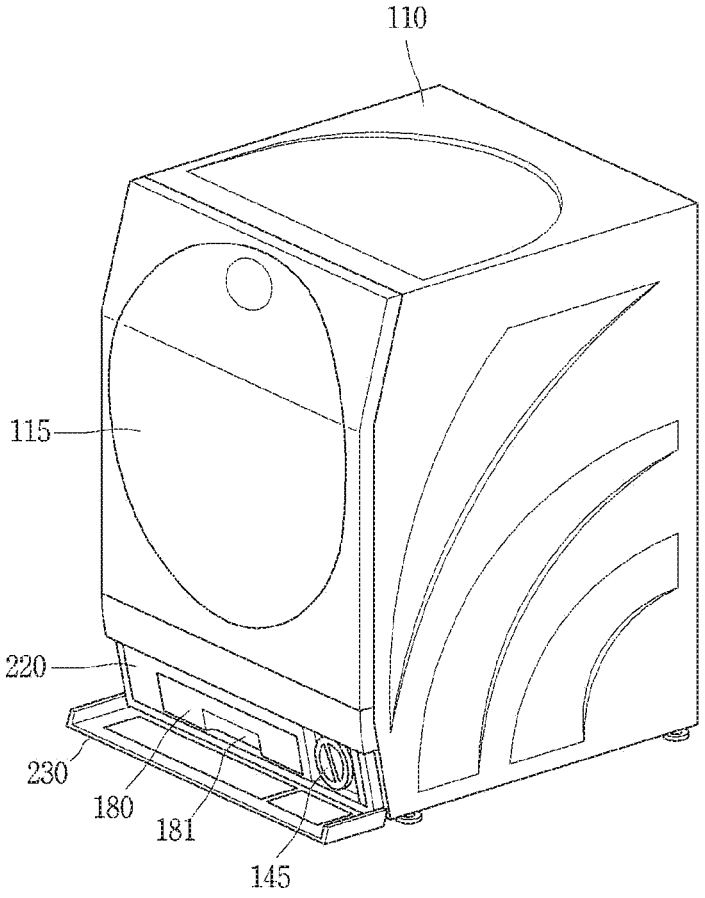
FIG. 1 is a perspective view of a laundry treating apparatus in accordance with one embodiment.

Description will now be given in detail of exemplary embodiments disclosed herein, with reference to the accompanying drawings.

In describing the present invention, moreover, the detailed description will be omitted when a specific description for publicly known technologies to which the invention pertains is judged to obscure the gist of the present invention. Also, it should be noted that the accompanying drawings are merely illustrated to easily explain the spirit of the invention, and therefore, they should not be construed to limit the spirit of the invention by the accompanying drawings.

A laundry treating apparatus is a type of an apparatus for treating (washing) clothes or laundry through a washing process and a rinsing process. The term laundry as used herein includes not only clothes but also various types of washable articles clothes, bedding, curtains, stuffed dolls, and the like.

The laundry treating apparatus may have a dehydrating function of spinning washed clothes or laundry at a preset speed to dehydrate moisture. Some of such laundry treating apparatuses may have a drying function of drying the washed clothes or laundry by supplying heated air.

Meanwhile, the laundry treating apparatus may have a washing agent supplying function to supply detergent or washing agent (hereinafter, referred to as 'washing agent') to improve a washing effect. Here, the washing agent may include various materials, such as laundry detergents, fabric softeners, bleaching agents and the like, which enhance the washing effect. As the washing agent, a powder washing agent, a liquid washing agent or a gel-type washing agent may be used.

The powder washing agent has a disadvantage in that not all of the powder may be dissolved after washing due to its relatively low dissolution, and detergent ingredients may remain in the tub or on the laundry. In consideration of such problems with powder washing agents, liquid washing agents having relatively high dissolution have seen increased use.

Laundry treating apparatuses may have a liquid washing agent supply device for supplying a liquid washing agent to washing water. The liquid washing agent supply device may include a storage container in which the liquid washing agent is stored, and a pump provided at a discharge side of the storage container.

The storage container of the liquid washing agent may be provided with a residual quantity detecting unit that detects a residual quantity or low level of the stored liquid washing agent. However, in certain laundry treating apparatuses in which the residual quantity detecting unit is installed at the storage container, the residual quantity detecting unit may interfere with access and may make it difficult to draw out the storage container. Also, the storage container may be fixed to a cabinet, which may make it difficult to fill the liquid washing agent into the storage container. In addition, due to the difficulty in drawing out the storage container, it may be difficult and inconvenient to wash an inside of the storage container. Accordingly, a laundry treating apparatus and method for supplying washing agent that addresses these and other disadvantages are disclosed hereinafter.

Figure 2:
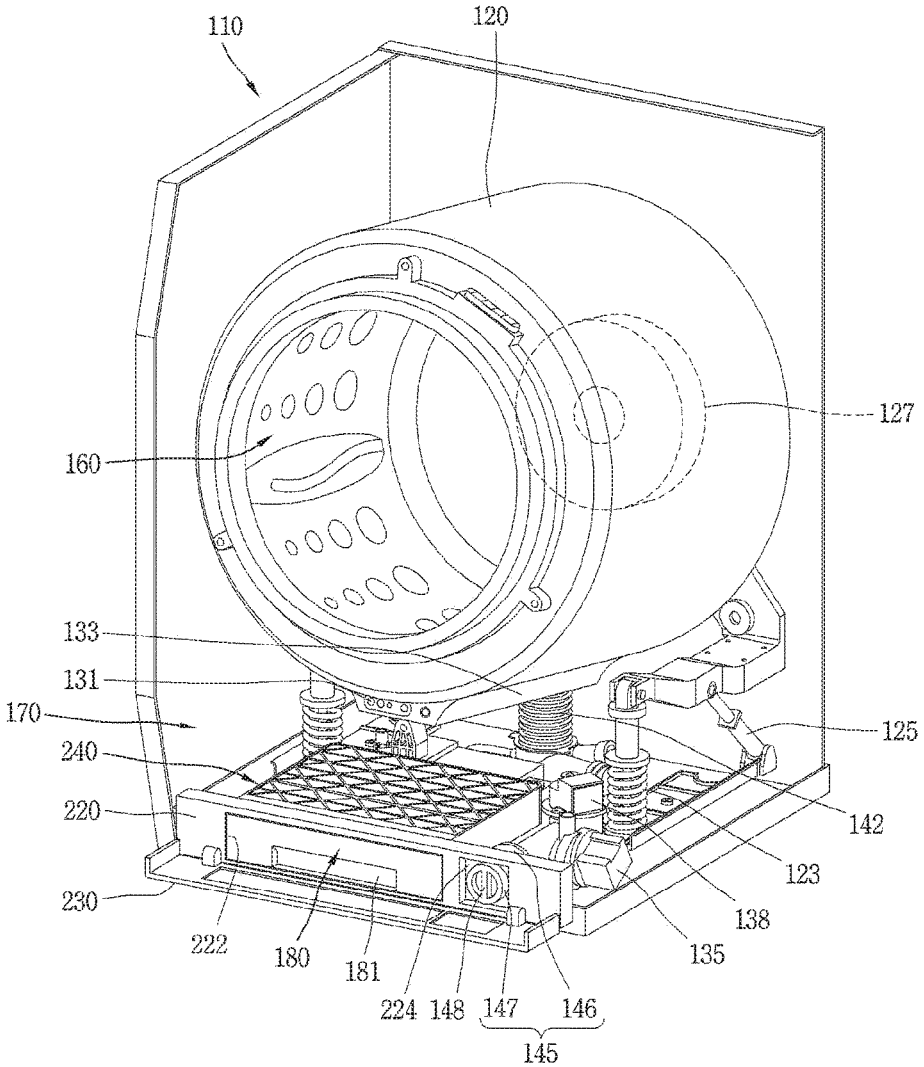
FIG. 2 is a view illustrating an inside of the laundry treating apparatus of FIG. 1.

As illustrated in FIGS. 1 and 2, a laundry treating apparatus in accordance with one embodiment of the present disclosure may include a cabinet 110, a tub 120 provided in the cabinet 110, a rotary tub (or drum) 160 provided in the tub 120 in a rotatable manner, and a washing agent supply unit 170 that supplies the liquid washing agent into the tub 120. The washing agent supply unit 170 may include a storage container 180 configured to be drawn out of the cabinet 110 and may store therein a liquid washing agent. The liquid washing agent may be liquid detergent or liquid softener (softening agent). A washing agent supply passage 190 may be formed between the storage container 180 and the tub 120, and a pump may be provided in the washing agent supply passage 190. A residual quantity detecting unit 250 (see FIG. 4) may be provided in the washing agent supply passage 190 to detect a residual quantity or a low level of the liquid washing agent. A laundry quantity detecting unit 315 (see FIG. 10) may be provided to detect a quantity of laundry within the rotary tub 160. A controller 310 (see FIG. 10) may be provided to control the washing agent supply unit 170 to supply an amount of liquid washing agent corresponding to the washing agent supply passage 190 as well as an amount of liquid washing agent corresponding to the quantity of the laundry detected by the laundry quantity detecting unit 315, for example, when the liquid washing agent is initially supplied into the tub 120 after the residual quantity detecting unit 250 detects a residual quantity shortage of the liquid washing agent.

The cabinet 110 may be implemented in an approximately rectangular parallelepiped shape. The tub 120 may be provided within the cabinet 110. The tub 120, for example, may be implemented in a cylindrical shape with one opening. The tub 120 may be supported by a plurality of elastic members 123 and/or dampers 125. Accordingly, vibration or shaking of the tub 120 can be prevented.

The rotary tub (or drum) 160 may be provided within the tub 120. The rotary tub 160, for example, may be implemented in a cylindrical shape with one opening. A driving motor 127 that rotates the rotary tub 160 may be provided in a rear end portion of the tub 120.

The openings of the tub 120 and the rotary tub 160 may be disposed to face the front surface of the cabinet 110, respectively. A door 115 through which the laundry to be washed is introduced and taken away may be provided on a front surface of the cabinet 110. The door 115 may be configured to open and close the opening of the tub 120. The door 115, for example, may be formed in a shape similar to a disk or another appropriate shape or style. The door 115, for example, may be rotatable in left and right directions centering on a hinge shaft that is disposed in up and down directions.

An electric heater 131 that heats water when power is supplied may be provided, for example, in a lower area of the tub 120. A water collecting unit 133 in which water is collected high enough for the electric heater 131 to be submerged in the water may be provided in the lower area of the tub 120. The water collecting unit 133, for example, may downwardly protrude from a lower portion of the tub 120.

A drain pump 135 for draining water of the tub 120 may be provided below the tub 120. A circulation passage 139, through which water is discharged out of the tub 120 and introduced into an upper area of the tub 120 in a circulating manner, may be provided at a lower side of the tub 120. A filter unit 145 that filters off foreign materials from water discharged out of the tub 120 may be provided at one side of the drain pump 135. The filter unit 145 may include a filter casing 146, and a filter 147 drawn out of and insertable into the filter casing 146. A handle 148 that facilitates coupling to and separation from the filter casing 146 may be provided on a front surface of the filter 147.

Figure 3:
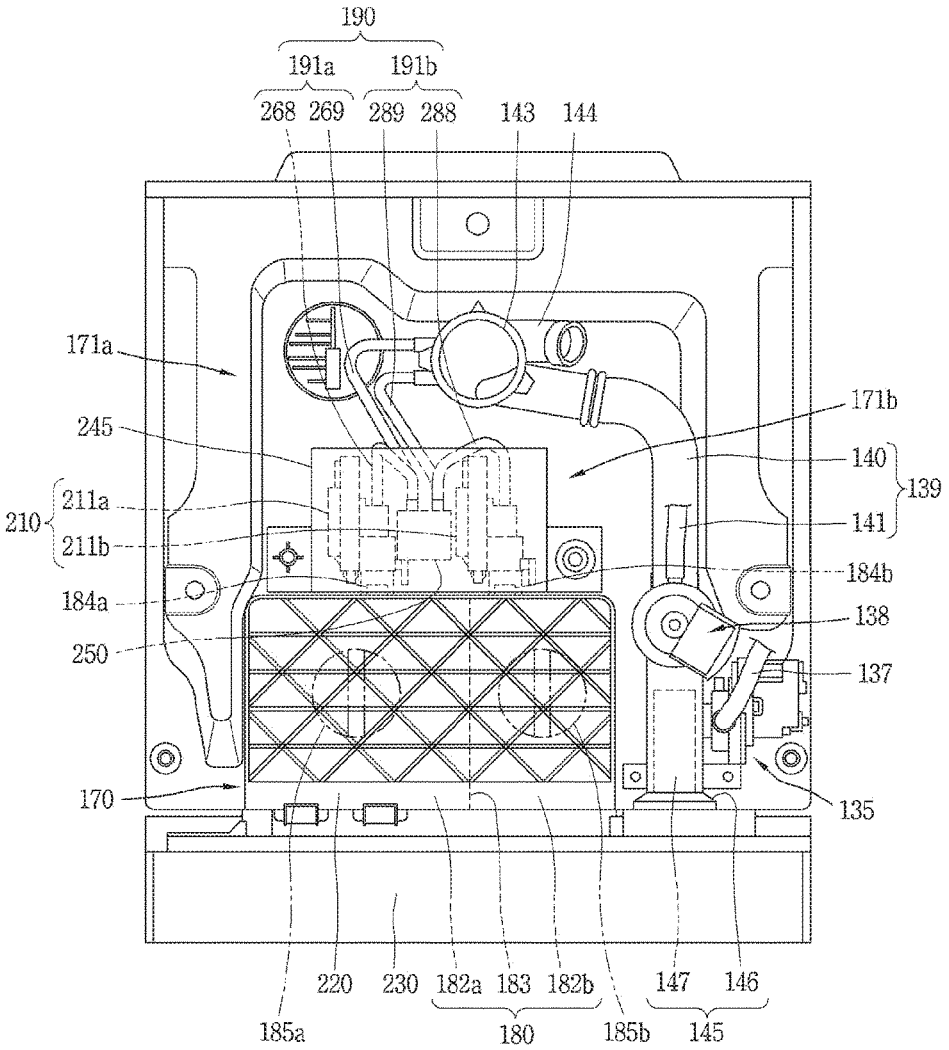
FIG. 3 is a planar view without a tub of FIG. 2.

The filter casing 146, for example, as illustrated in FIG. 3, may be connected to another end of a circulation pipe 140 that has one side connected to the tub 120 and forms one area of the circulation passage 139. Here, the circulation passage 139 may include the circulation pipe 140, a discharge pipe 141 connected to a discharge side of a circulation pump 138, which will be explained later, and a bellows 142.

A bellows connecting portion 143 that allows the bellows 142 to be connected to the tub 120 may be formed on one side of the circulation pipe 140. The bellows connecting portion 143, for example, may be formed in a semi-circular shape with an upper opening. A water level detecting portion pipe 144 that communicates with the tub 120 to detect a water level of the tub 120 may be connected to one side of the bellows connecting portion 143.

The discharge pipe 141 with one end connected to an upper area of the tub 120, for example, as illustrated in FIG. 3, may be connected to the discharge side of the circulation pump 138. A drain pipe 137 may be provided through which completely-used washing water that has passed through the filter unit 145 is discharged out. The drain pipe 137 may be connected to the discharge side of the drain pump 135.

Meanwhile, a washing agent supply unit 170 that supplies a washing agent into the tub 120 may be provided in the cabinet 110. The washing agent supply unit 170, for example, may be located below the tub 120.

The washing agent, for example, may refer to a variety of materials including a liquid washing detergent and a liquid fabric softener, which can improve a washing effect of the laundry.

The washing agent supply unit 170 may include a storage container 180 that stores therein a liquid washing agent including a liquid detergent or liquid softener. The storage container 180 may be configured to be drawn out of the cabinet 110. A washing agent supply passage 190 may be disposed between the storage container 180 and the tub 120, and a pump 210 may be provided in the washing agent supply passage 190.

The washing agent supply unit 170, for example, may include a frame 220 having a draw-out opening 222 formed therethrough such that the storage container 180 is drawn out through the draw-out opening 222. Here, the storage container 180 may be slidably coupled to the frame 220. A cover 230 may be coupled to a front surface of the frame 220 in a rotatable manner to cover the opening 222.

The frame 220 may be located in a front lower area of the cabinet 110. The cover 230 may be rotatable up and down centering on a rotation shaft provided on a lower portion of the frame 220. The cover 230 may be disposed to forwardly protrude from a lower portion of the frame 220 upon being opened. A storage container accommodating portion 240 in which the storage container 180 is accommodated may be provided at the rear of the frame 220.

A filter opening 224 through which the filter 147 is attached and detached may be formed at one side of the draw-out opening 222 of the frame 220. The cover 230 may be configured to simultaneously close the draw-out opening 222 of the storage container 180 and the filter opening 224.

The storage container 180 may be configured to separately store a liquid fabric detergent and a liquid fabric softener. A handle 181 that is pulled forward to draw the storage container 180 out may be provided on a front surface of the storage container 180. A detergent storing portion 182*a* in which the liquid fabric detergent is stored may be provided in one side area of the storage container 180. A softener storing portion 182*b* in which the liquid fabric softener is stored may be provided in another side area of the storage container 180. The description of this embodiment, the detergent storing portion 182*a* is described as being located at a left area and the softener storing portion 182*b* as being located at a right area in the drawing (FIG. 3) of the storage container 180, but their locations may alternatively be switched with each other.

A partition wall 183 may be interposed between the detergent storing portion 182*a* and the softener storing portion 182*b* to separate/partition the detergent storing portion 182*a* and the softener storing portion 182*b* from each other. The detergent storing portion 182*a* and the softener storing portion 182*b* may be configured to store different quantities of detergent and softener according to types and usage amounts of the detergent and the softener. This embodiment exemplarily illustrates that a size of the detergent storing portion 182*a* is greater than the softener storing portion 182*b*, but their sizes may appropriately be adjusted.

A detergent injection opening cover 185*a* may be provided on an upper end of the detergent storing portion 182*a*, to selectively open and close a detergent injection opening such that liquid detergent can be injected into the detergent storing portion 182*a*. A softener injection opening cover 185*b* may be provided on an upper end of the softener storing portion 182*b*, to selectively open and close a softener injection opening such that liquid fabric softener can be injected into the softener storing portion 182*b*.

Meanwhile, a pump 210 for supplying a liquid washing agent may be provided at a rear area of the storage container accommodating portion 240. The pump 210, for example, may include a detergent pump 211*a* and a softener pump 211*b* for supplying the liquid detergent and the liquid softener, respectively. The detergent pump 211*a* may communicate with the detergent storing portion 182*a*. The softener pump 211*b* may communicate with the detergent storing portion 182*b*.

A detergent pump connecting portion 184*a* and a softener pump connecting portion 184*b* which are in communication with the detergent pump 211*a* and the softener pump 211*b*, respectively, may be provided on a rear surface of the storage container 180. Here, the detergent pump connecting portion 184*a* and the softener pump connecting portion 184*b* may be configured to allow the detergent storing portion 182*a* and the softener storing portion 182*b* to communicate with the detergent pump 211*a* and the softener pump 211*b*, respectively, while the storage container 180 is accommodated, and to prevent a leakage of the detergent from the detergent storing portion 182*a* and a leakage of the softener from the softener storing portion 182*b* while the storage container 180 is drawn out.

An installation space 245 for the detergent pump 211*a* and the softener pump 211*b* may be provided at one side (at the rear side in the drawing) of the storage container accommodating portion 240. The installation space 245, for example, may be implemented in a rectangular parallelepiped shape with a rear opening. The installation space 245, for example, may simultaneously accommodate the detergent pump 211*a* and the softener pump 211*b*, respectively.

Meanwhile, a washing agent supply passage 190 through which the liquid washing agent is supplied into the tub 120 may be provided at the rear area of the storage container accommodating portion 240. The washing agent supply passage 190, for example, may be provided with a detergent supply passage 191*a* for supplying the detergent, and a softener supply passage 191*b* for supplying the softener.

The washing agent supply passage 190, for example, may be provided with a residual quantity detecting unit 250 (see FIG. 3) that detects a residual quantity of the liquid washing agent. As such, the residual quantity detecting unit 250 may be installed in a manner of being separated from the storage container 180, thereby facilitating a movement of the storage container 180. The residual quantity detecting unit 250, for example, as illustrated in FIG. 3, may be disposed between the detergent pump 211*a* and the softener pump 211*b*.

Figure 5:
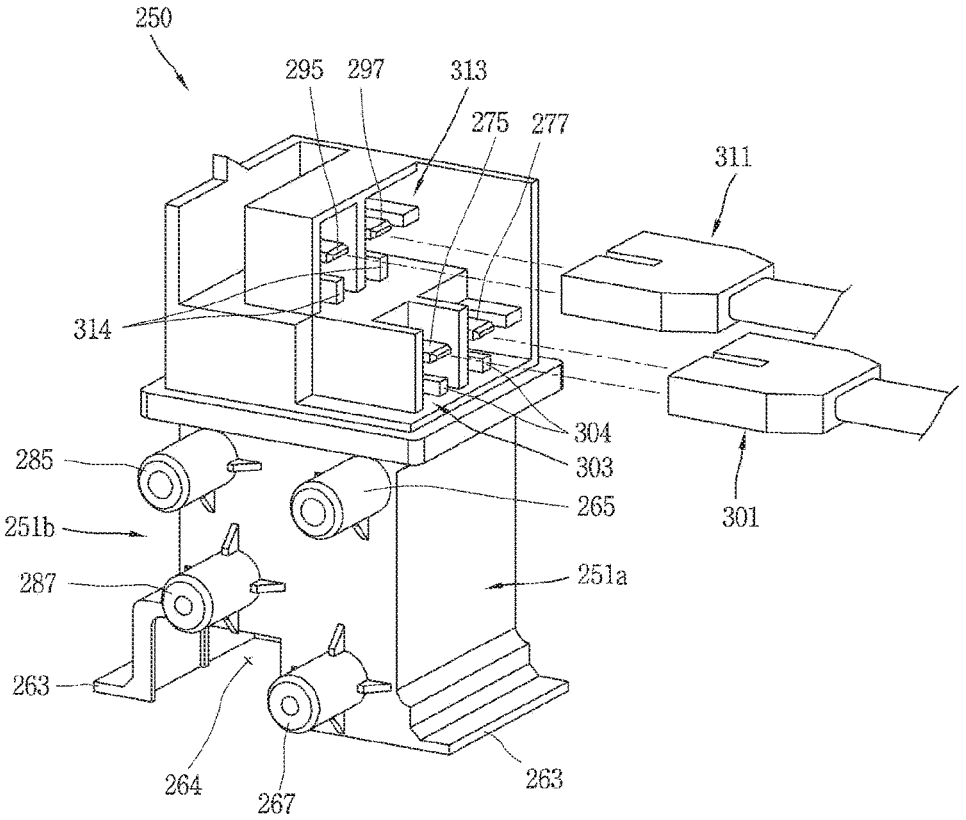
FIG. 5 is a perspective view of a residual quantity detecting unit of FIG. 4.
Figure 6:
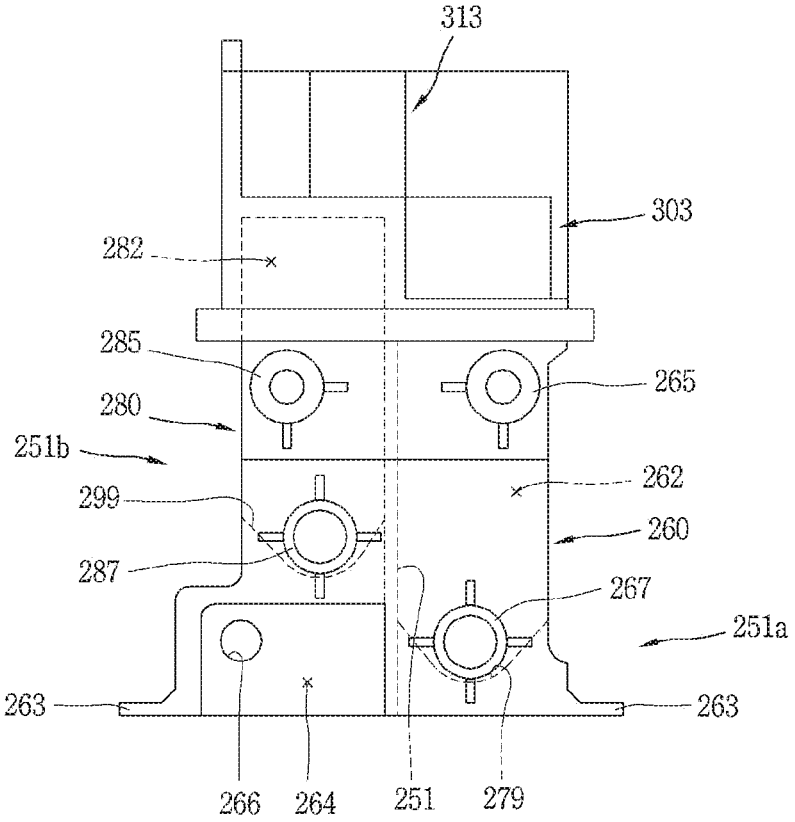
FIG. 6 is a front view of FIG. 5.
Figure 7:
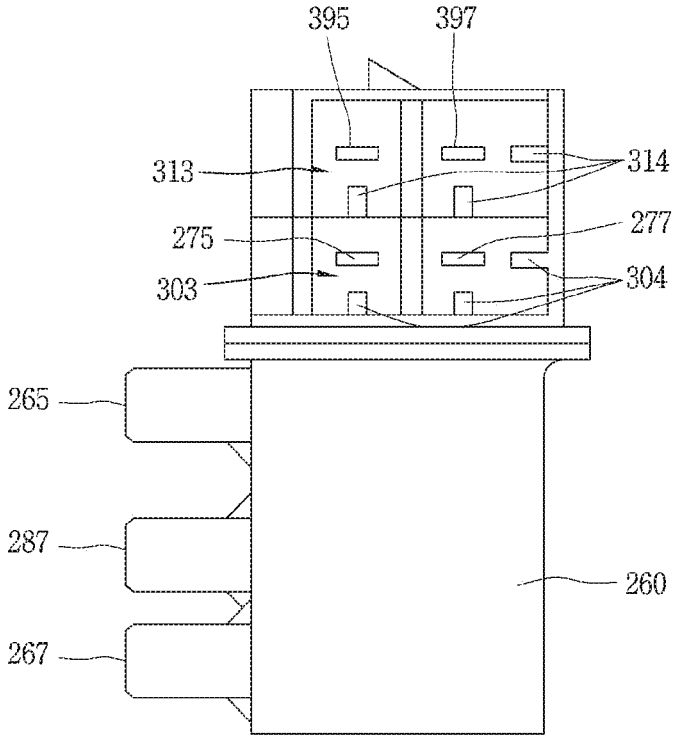
FIG. 7 is a right view of FIG. 4.

Referring to FIGS. 5 to 7 the residual quantity detecting unit 250, for example, may include cases 260 and 280 that defines internal hermetic spaces 262 and 282, introduction parts 265 and 285 provided on one side of each of the cases 260 and 280 to communicate with the hermetic spaces 262 and 282, discharge parts 267 and 287 communicating with the hermetic spaces 262 and 282, and electrodes 270 and 290 downwardly extending in the hermetic spaces 262 and 282.

Here, the residual quantity detecting unit 250 may be connected to the detergent pump 211*a* and the softener pump 211*b*, respectively, and accordingly air existing within the hermetic spaces 262 and 282 can be compressed upon supplying the liquid detergent and the liquid softener. This may prevent bubbles, which may be generated during the supply (or flow) of the liquid detergent and/or softener, from flowing up toward an upper area of the hermetic space 262, 282. This configuration can prevent an incorrect detection of a residual quantity which may result from the bubbles generated during the flow of the liquid detergent or softener.

The residual quantity detecting unit 250, for example, may include a residual detergent detecting portion 251*a* that detects a residual quantity of the detergent, and a residual softener detecting portion 251*b* that detects a residual quantity of the softener. The residual detecting unit 250, for example, as illustrated in FIGS. 5 to 7, may be configured such that the residual detergent detecting portion 251*a* and the residual softener detecting portion 251*b* are formed integral with each other. This may simplify a fixing structure to mount the residual quantity detecting unit 250 and facilitate fabrication and installation.

This embodiment exemplarily illustrates that the residual quantity detecting unit 250 includes the residual detergent detecting portion 251*a* and the residual softener detecting portion 251*b* which are integrally formed with each other. However, the embodiment is not limited thereto. Alternatively, the residual quantity detecting unit 250 may be implemented separately as a residual detergent detecting unit detecting a residual quantity of detergent, and a residual softener detecting unit detecting a residual quantity of softener.

The residual detergent detecting portion 251*a* may include a case 260 that defines an internal hermetic space 262, an introduction part 265 provided on one side of the case 260 in communication with the hermetic space 262, a discharge part 267 in communication with the hermetic space 262, and an electrode 270 (see FIG. 8) that extends downward within the hermetic space 262. Moreover, the residual softener detecting portion 251*b* may include a case 280 defining an internal hermetic space 282, an introduction part 285 provided on one side of the case 280 in communication with the hermetic space 282, a discharge part 287 in communication with the hermetic space 282, and an electrode 290 (see FIG. 9) that extends downward within the hermetic space 282. The introduction parts 265 and 285 and discharge parts 267 and 287 may be referred to herein as ports or inlets/outlets.

This embodiment exemplarily illustrates that the case 260 of the residual detergent detecting portion 251*a* and the case 280 of the residual softener detecting portion 251*b* are integrally formed with each other. The residual detergent detecting portion 251*a* and the residual softener detecting portion 251*b* may be integrally formed with each other interposed with one common partition wall 261 therebetween.

Figure 4:
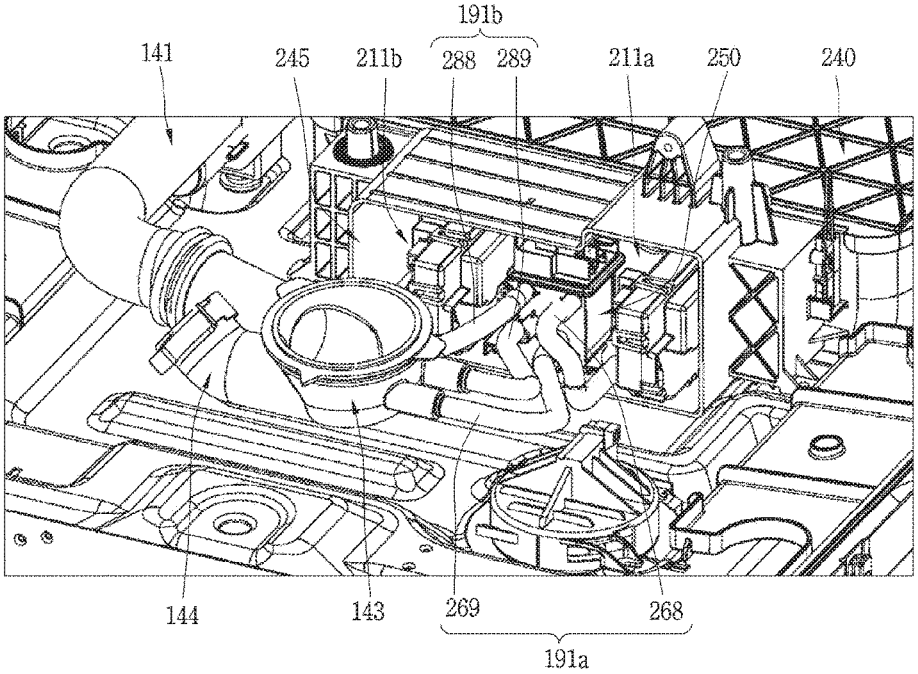
FIG. 4 is an enlarged perspective view of a washing agent supply unit area of FIG. 3.

The residual detergent detecting portion 251*a* and the residual softener detecting portion 251*b*, for example, may be configured based on FIG. 4 such that the residual detergent detecting portion 251*a* is located at a right side and the residual softener detecting portion 251*b* is located at a left side. It should be appreciated that alternative arrangements are also possible.

Figure 8:
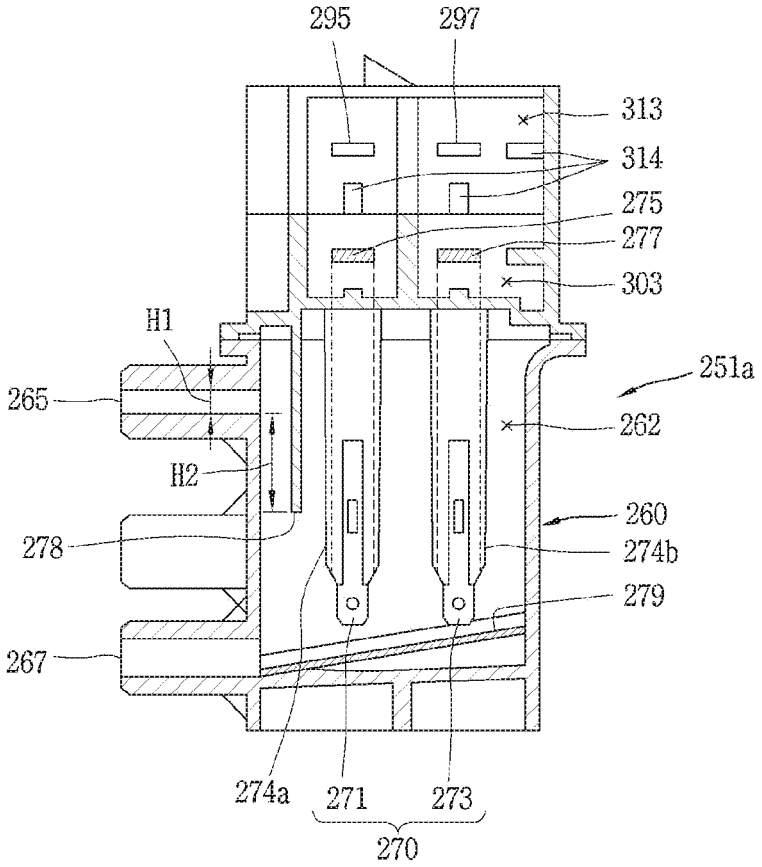
FIG. 8 is a sectional view of a detergent detecting unit in the residual quantity detecting unit of FIG. 5.
Figure 9:
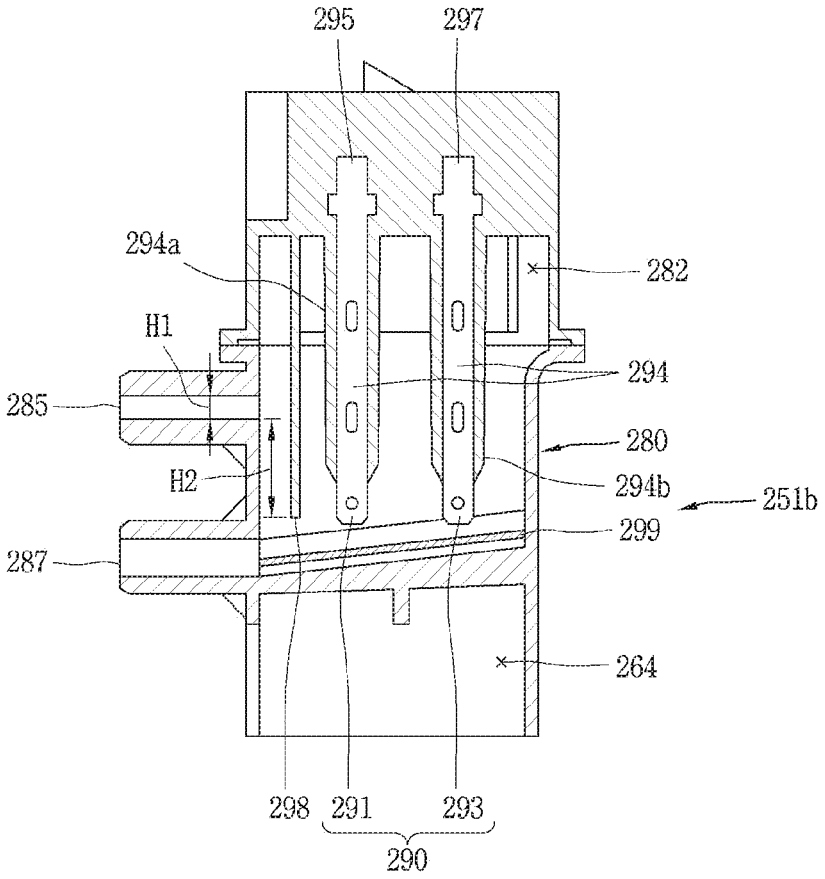
FIG. 9 is a sectional view of a softener detecting unit in the residual quantity detecting unit of FIG. 5.

The electrode 270 of the residual detergent detecting portion 251*a*, as illustrated in FIG. 8, may be provided with a pair of first and second electrodes 271 and 273 that are spaced apart from each other. The electrode 290 of the residual softener detecting portion 251*b*, as illustrated in FIG. 9, may be provided with a pair of first and second electrodes 291 and 293 that are spaced apart from each other.

The introduction part 265 and the discharge part 267 may protrude from one side of the hermetic space 262 of the residual detergent detecting portion 251*a*. The introduction part 265 and the discharge part 267 may be spaced apart from each other, and the first and second electrodes 271 and 273 of the residual detergent detecting portion 251*a*, and may be arranged to protrude in a direction in which the electrodes 291 and 293 are aligned or spaced. The introduction part 265 and the discharge part 267 may be referred to as ports. Ports 265 and 267 may protrude in a direction extending toward the electrodes 271 and 273.

The introduction part 265 of the residual detergent detecting portion 251*a* may be connected with another end of a detergent introduction pipe 268, which has one end connected to the detergent pump 211*a*, so as to allow for an introduction of the detergent. The discharge part 267 of the residual detergent detecting portion 251*a* may be connected with another end of a detergent discharge pipe 268, which has one end connected to a bellows connecting portion 143, so as to allow for a discharge of the detergent.

The introduction part 285 and the discharge part 287 (or ports) may outwardly protrude from one side of the hermetic space 282 of the residual softener detecting portion 251*b* and spaced apart from each other and the first and second electrodes 291 and 293 of the residual detergent detecting portion 251*b*. The ports 285 and 287 may extend in a direction toward/from the electrodes 291 and 293 and may be arranged to protrude in a direction in which the electrodes 291 and 293 are aligned or spaced.

The introduction part 285 of the residual softener detecting portion 251*b* may be connected with another end of a softener introduction pipe 288, which has one end connected to a discharge side of the softener pump 211*b*, so as to allow for an introduction of the softener. The discharge part 287 of the residual softener detecting portion 251*b* may be connected with another end of a softener discharge pipe 289, which has one end connected to the bellows connecting portion 143, so as to allow for a discharge of the softener.

Here, the detergent discharge connecting pipe 269 and the softener discharge connecting pipe 289 may be connected to the bellows connecting portion 143, respectively, such that the detergent and softener can be supplied to the laundry after being mixed with washing water, without being directly supplied to the laundry. Accordingly, the detergent or softener does not directly contact the laundry without being diluted, thereby preventing damage on the laundry.

The discharge part 287 of the residual softener detecting portion 251*b* may be connected to another end of the softener discharge connection pipe 289 which has one end connected to the bellows connecting portion 143.

Meanwhile, the residual detergent detecting portion 251*a* and the residual softener detecting portion 251*b* may be spaced apart from each other with a height difference in a vertical or up and down directions. In more detail, the residual softener detecting portion 251*b* may be disposed higher than the residual detergent detecting portion 251*a*.

Extending portions 263 may outwardly extend in a widthwise direction from one side of a lower area of the case 260 and 280. This may result in increasing supporting force with respect to a horizontal direction when external force is applied to the cases 260 and 280 in the horizontal direction. The hermetic space 282 of the residual softener detecting portion 251*b* and the hermetic space 262 of the residual detergent detecting portion 251*a*, for example, may have the same volume.

The hermetic space 282 of the residual softener detecting portion 251*b*, for example, may be disposed higher than the hermetic space 262 of the residual detergent detecting portion 251*a*. Accordingly, a space 264 may be formed below the residual softener detecting portion 251*b*.

A through hole 266 may be formed through a rear wall of the space 264. A screw which is fixed to a wall surface of the installation space 245 may be inserted through the through hole 266, for example. Accordingly, the residual quantity detecting unit 250 may be fixed to the installation space 245.

Meanwhile, terminals 295 and 297 that are electrically connected to the electrodes 291 and 293 may be provided on an upper end of the residual softener detecting portion 251*b*, respectively. Each terminal 295, 297 of the residual softener detecting portion 251*b* may be bent from an upper end of the electrode 291, 293 and horizontally extend.

A softener connector connecting portion 313 connectable with a softener connector 311, which is connected to the terminals 295 and 297 of the residual softener detecting portion 251*b*, may be formed adjacent to the terminals 295 and 297 of the residual softener detecting portion 251*b*. The softener connector connecting portion 313 may be provided with guide ribs 314 that guide connection and separation of the softener connector 311.

Terminals 275 and 277 that are electrically connected to the electrodes 271 and 273 of the residual detergent detecting portion 251*a* may be provided on an upper end of the residual detergent detecting portion 251*a*. Each terminal 275, 277 of the residual detergent detecting portion 251*a* may be bent from an upper end of the electrode 271, 273 of the residual detergent detecting portion 251*a* and horizontally extend.

A detergent connector connecting portion 303 connectable with a detergent connector 301, which is connected to the terminals 275 and 277 of the residual detergent detecting portion 251*b*, may be formed adjacent to the terminals 275 and 277 of the residual detergent detecting portion 251*a*. The detergent connector connecting portion 303 may be provided with guide ribs 304 that guide connection and separation of the detergent connector 301.

The softener connector connecting portion 313 may be disposed higher than the detergent connector connecting portion 303, which may result in preventing interference between the connector 313 of the residual softener detecting portion 251*b* and the connector 301 of the residual detergent detecting portion 251*a*, upon the connection and separation thereof.

Also, the detergent connector connecting portion 303 and the softener connector connecting portion 313 may be disposed in an intersecting direction with (e.g., a perpendicular direction to) the introduction parts 265 and 285 and the outlets 267 and 287, respectively, thereby preventing interference with the detergent introduction pipe 268 and/or the detergent discharge pipe 269 upon the connection and separation of the connectors 301 and 311, respectively.

This embodiment exemplarily illustrates that the detergent connector connecting portion 303 and the softener connector connecting portion 313 are connected with and separated from the connectors 301 and 311, respectively, from the right side in FIG. 5. However, this is merely illustrative. For example, the connectors 301 and 311 may alternatively be connected to and separated from the detergent connector connecting portion 303 and the softener connector connecting portion 313 from the left side in FIG. 5 or another appropriate configuration for connector portion placement.

Here, the connector 301 of the residual detergent detecting portion 251*a* and the connector 311 of the residual softener detecting portion 251*b* may be connected to a controller 310 to perform communication with the controller 310.

The introduction part 285 of the residual softener detecting portion 251*b* and the introduction part 265 of the residual detergent detecting portion 251*a* may be provided at the same height. The discharge part 287 of the residual softener detecting portion 251*b* may be disposed higher than the discharge part 267 of the residual detergent detecting portion 251*a*.

Meanwhile, as illustrated in FIG. 8, the first electrode 271 and the second electrode 273 may be disposed, with being spaced apart from each other, within the residual detergent detecting portion 251*a*. A first supporting portion 274*a* and a second supporting portion 274*b* that support the first electrode 271 and the second electrode 273, respectively, in a covering manner may extend downward from an upper surface or ceiling of the hermetic space 262 of the residual detergent detecting portion 251*a*. The first electrode 271 and the second electrode 273 may protrude downward from lower ends of the first supporting portion 274*a* and the second electrode 274*b*, respectively.

A preventing portion 278 for preventing direct contact between liquid detergent introduced through the introduction part 265 and the first and second electrodes 271 and 273 may be interposed between the introduction part 265 of the residual detergent detecting portion 251*a* and the first electrode 271. The preventing portion 278 may be a baffle and may be implemented, for example, in a plate-like shape. The preventing portion 278 may extend down from an upper surface or top of the hermetic space 262 or provided to extend from a sidewall of the hermetic space 262, at a prescribed distance from the introduction part 265.

The preventing portion 278, for example, may extend downward past a bottom portion (or bottom) of the introduction part 265 to have a length or height H2 (extending length) which is 1.5 to 3 times greater than a length or height H1 of a flow cross-sectional area of the introduction part 265.

A detergent guide portion 279 that guides detergent introduced through the introduction part 265 may be disposed at a lower portion of the hermetic space 262 of the residual detergent detecting portion 251*a*. The detergent guide portion 279, for example, may have a concave arcuate cross-sectional area that is upwardly open and has a downwardly-protruding center. The detergent guide portion 279, for example, may be downwardly inclined toward the discharge part 267 such that the detergent inside the hermetic space 262 can flow toward the discharge part 267.

Meanwhile, as illustrated in FIG. 9, the first electrode 291 and the second electrode 293 may be disposed within the hermetic space 282 of the residual softener detecting portion 251*b* in a manner of being spaced apart from each other and extending downward. A first supporting portion 294*a* and a second supporting portion 294*b* that extend downward from the upper surface or ceiling to support the first electrode 291 and the second electrode 293, respectively, may be provided within the hermetic space 282 of the residual softener detecting portion 251*b*.

The hermetic space 282 of the residual softener detecting portion 251*b* may be spaced upward apart from a lower portion of the case 280 by a preset height.

The introduction part 285 and the discharge part 287 may protrude outward from one side of the hermetic space 282 of the residual softener detecting portion 251*b*, respectively. The introduction part 285 and the discharge part 287 may be spaced apart from each other and the first electrode 291 and the second electrode 293. The introduction part 285 and the discharge part 287 may be positioned to extend in a direction in line or toward the first electrode 291 and the second electrode 293 and may be arranged to protrude in a direction in which the electrodes 291 and 293 are aligned or spaced.

The introduction part 285 of the residual softener detecting portion 251*b* may be provided above the discharge part 287 in a spaced manner. The introduction part 285 of the residual softener detecting portion 251*b* may be spaced downward apart from the upper surface or ceiling of the hermetic space 282.

A preventing portion 298 for preventing a direct contact between the softener introduced through the introduction part 285 and the first electrode 291 and the second electrode 293 may be interposed between the introduction part 285 of the residual softener detecting portion 251*b* and the first electrode 291. The preventing portion 298 may be a baffle. The preventing portion 298 may extend downward from an upper surface or ceiling of the hermetic space 282. The preventing portion 298 may also be fixed or formed integrally at a prescribed distance from the introduction part 285 from, for example, a sidewall of the hermetic space 282.

The preventing portion 298, for example, may extend down past a bottom surface of the introduction part 285 of the residual softener detecting portion 251*b* to have a length or height H2 which is 1.5 to 3 times greater than a length or height H1 of a flow cross-sectional area of the introduction part 285.

A softener guide portion 299 that guides softener introduced into the hermetic space 282 of the residual softener detecting portion 251*b* toward the discharge part 287 may be disposed at a lower portion of the hermetic space 282. The softener guide portion 299, for example, may have a concave arcuate cross-sectional area that is upwardly open and has a downwardly-protruding center. The softener guide portion 299, for example, may be downwardly inclined toward the discharge part 287 such that the inner softener can flow toward the discharge part 287.

Meanwhile, the laundry treating apparatus according to this embodiment of the present disclosure may include a controller 310 that controls the washing agent supplying unit 170 to supply the liquid washing agent. The controller 310 may add a quantity of the liquid washing agent corresponding to a volume of the washing agent supply passage 190 in addition to a quantity of the liquid washing agent corresponding to a quantity of the laundry accommodated in the rotary tub 160, for example, when the liquid washing agent is initially supplied to the tub 120 after detecting a residual quantity shortage of the liquid washing agent.

Here, when a residual quantity shortage of the washing agent within the storage container 180 occurs and washing agent is refilled into the storage container 180, a correct amount of washing agent may not initially be supplied to mix with washing water. This is due to the washing agent first filling the washing agent supply passage 190 from an inlet of the pump 210 up to the bellows connecting portion 143, which is a point where the washing agent is brought into contact with the washing water. Accordingly, even though the pump 210 is operated after refilling the washing agent, a correct amount of washing agent may not be supplied to the washing water at initial operation of the pump 210. Therefore, the controller 180 may control to increase a supply quantity (or supply time) of the liquid washing agent by a quantity corresponding to a volume of the washing agent supply passage 190, thereby preventing such actual supply shortage of the liquid washing agent.

Here, the quantity corresponding to the washing agent supply passage 190 may refer to a quantity of the liquid washing agent corresponding to a volume from the inlet of the detergent pump 211*a* to the detergent discharge pipe 269. In more detail, for detergent, the quantity corresponding to the washing agent supply passage 190 may refer to a quantity of the liquid detergent corresponding to a volume from an inlet side of the detergent pump 211*a* to the detergent discharge pipe 269. Also, for softener, the quantity corresponding to the washing agent supply passage 190 may refer to a quantity of the liquid softener corresponding to a volume from an inlet of the softener pump 211*b* up to the softener discharge pipe 289.

The controller 310 may adjust the supply quantity of the liquid washing agent by controlling an operation time of the pump 210. Therefore, upon an initial supply of the liquid washing agent after detecting the residual quantity shortage of the liquid washing agent, a second quantity value corresponding to the volume of the washing agent supply passage 190 can also be controlled based on the operation time of the pump 210.

A first quantity value corresponding to the amount of laundry, for example, may be in the range of tens of seconds, and the second quantity value corresponding to the washing agent supply passage 190 may be in the range of several seconds. The second quantity value may be determined based on the specific application and known volume of the washing agent supply passage and pump flow rate.

Figure 10:
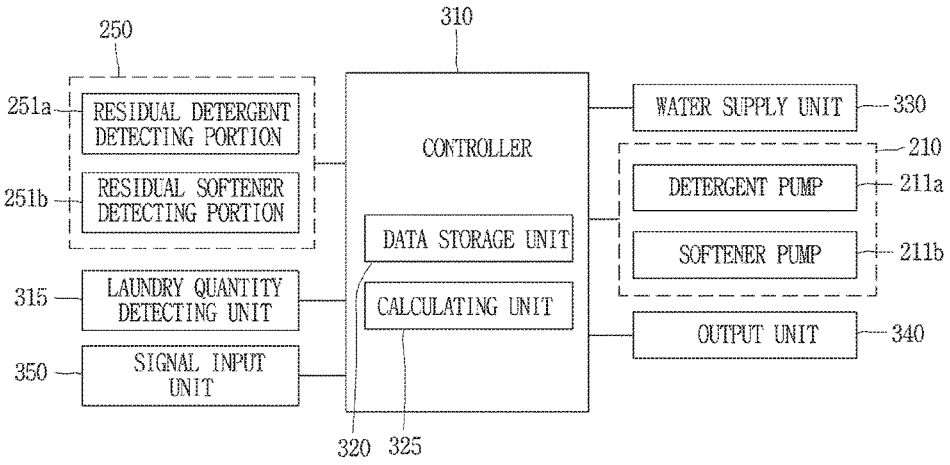
FIG. 10 is a control block diagram of the laundry treating apparatus of FIG. 1.

Referring to FIG. 10, the controller 310 may be connected to a water supply unit 330 and control the water supply unit 330 to supply washing water into the tub 120. The controller 310 may be connected with the residual quantity detecting unit 250 to detect the residual quantity of the washing agent.

In more detail, the controller 310 may be connected with the residual detergent detecting portion 251*a* to detect the residual quantity of the liquid detergent, in a manner of performing communication with the residual detergent detecting portion 251*a*. The controller 310 may also be connected with the residual softener detecting portion 251*b* to detect the residual quantity of the liquid softener.

The controller 310 may also be connected with the laundry quantity detecting unit 315, which detects a quantity of laundry accommodated in the rotary tub 160 by performing communication with the laundry quantity detecting unit 315.

The controller 310 may include a data storage unit 320 to store the first quantity value of the liquid washing agent set to correspond to a quantity of laundry detected by the laundry quantity detecting unit 315 and the second quantity value of the liquid washing agent set to correspond to the washing agent supply passage 190. The controller may also include a calculating unit 325 to calculate a third quantity value by adding the first quantity value with the second quantity value.

The controller 310 may determine the first quantity value as the supply quantity of the liquid washing agent when the supply of the liquid washing agent is not the initial supply after detecting the residual quantity shortage of the liquid washing agent.

The controller 310 may control the residual quantity detecting unit 250 to detect a residual quantity of the liquid washing agent after the supply of the liquid washing agent. When the residual quantity shortage is detected according to the detection result, the controller 310 may control the data storage unit 320 to store the residual quantity shortage detection result or store the residual quantity shortage detection result and then externally output the detection result.

The controller 310 may be connected with the residual quantity detecting unit 250 in a manner of performing communication with the residual quantity detecting unit 250. In more detail, the controller 310 may be connected with the residual quantity detecting unit 250 having the residual detergent detecting portion 251*a* and the residual softener detecting portion 251*b* in the manner of performing communication with them.

The controller 310 may be connected with a signal input unit 350, which allows an input of a refill completion signal of the washing agent after refilling the washing agent into the storage container 180. The controller 310 may be configured to perform communication with the signal input unit 350.

The controller 310 may be connected with the pump 210 including the detergent pump 211*a* and the softener pump 211*b* in a controllable manner such that the washing agent can be supplied. The controller 310 may also be connected with an output unit 340 and control the output unit 340 to externally output the residual quantity shortage detection result of the residual quantity detecting unit 250. Merely for convenience, the output unit 340 will be referred to hereinafter as a display 340. The residual quantity shortage detection result may also be externally output by another appropriate means, such as a sound output, LEDs on a control panel, or the like.

With the configuration, upon starting a washing stroke (or cycle), the controller 310 may control the laundry quantity detecting unit 315 to detect the quantity of the laundry and check whether or not a detergent supply is an initial supply after detecting a shortage of a residual quantity of detergent through the data storage unit 320. If the detergent supply is initially supplied, the controller 310 may control the calculating unit 325 to calculate a third quantity value by adding the first quantity value corresponding to the quantity of the laundry with the second quantity value corresponding to the detergent supply passage 191*a*, and control the detergent supply portion (the detergent pump 211*a*) to supply the detergent according to the third quantity value.

When the detergent supply is not the initial supply after detecting a shortage of the residual quantity of the detergent, the controller 310 may control the washing agent supply unit 170 (e.g., the detergent pump 211*a*) to supply the detergent by the first quantity value corresponding to the quantity of the laundry detected by the laundry quantity detecting unit 315.

After supplying the washing agent, the controller 310 may control the residual quantity detecting unit 250 to detect the residual quantity of the washing agent. When a residual quantity shortage is detected by the residual quantity detecting unit 250 (e.g., the residual detergent detecting portion 251*a*), the controller 310 may control the data storage unit 320 to store the detection result (the residual quantity shortage).

Figure 11A:
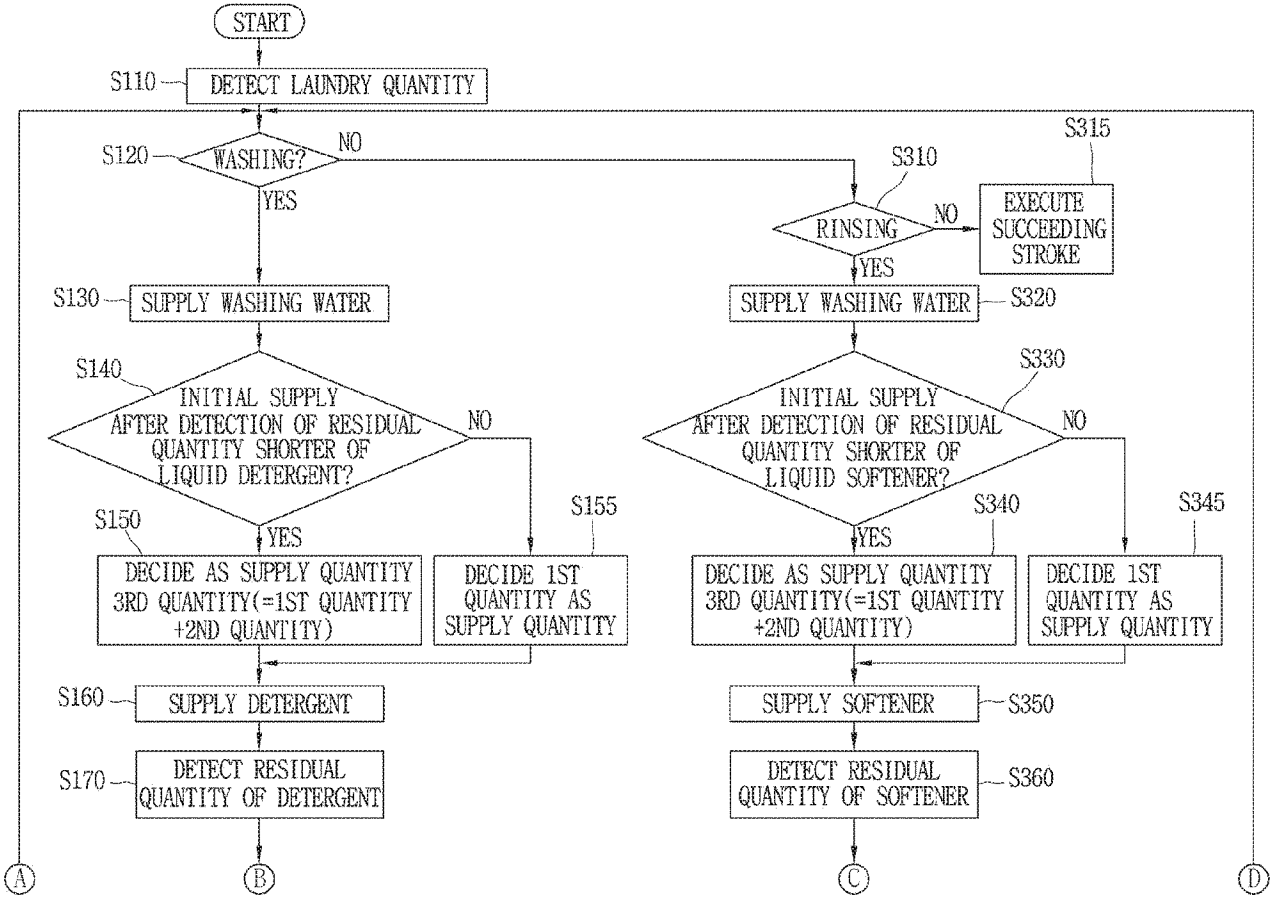
FIGS. 11A and 11B are flowcharts illustrating a method for supplying a washing agent of a laundry treating apparatus in accordance with one embodiment of the present disclosure.
Figure 11B:
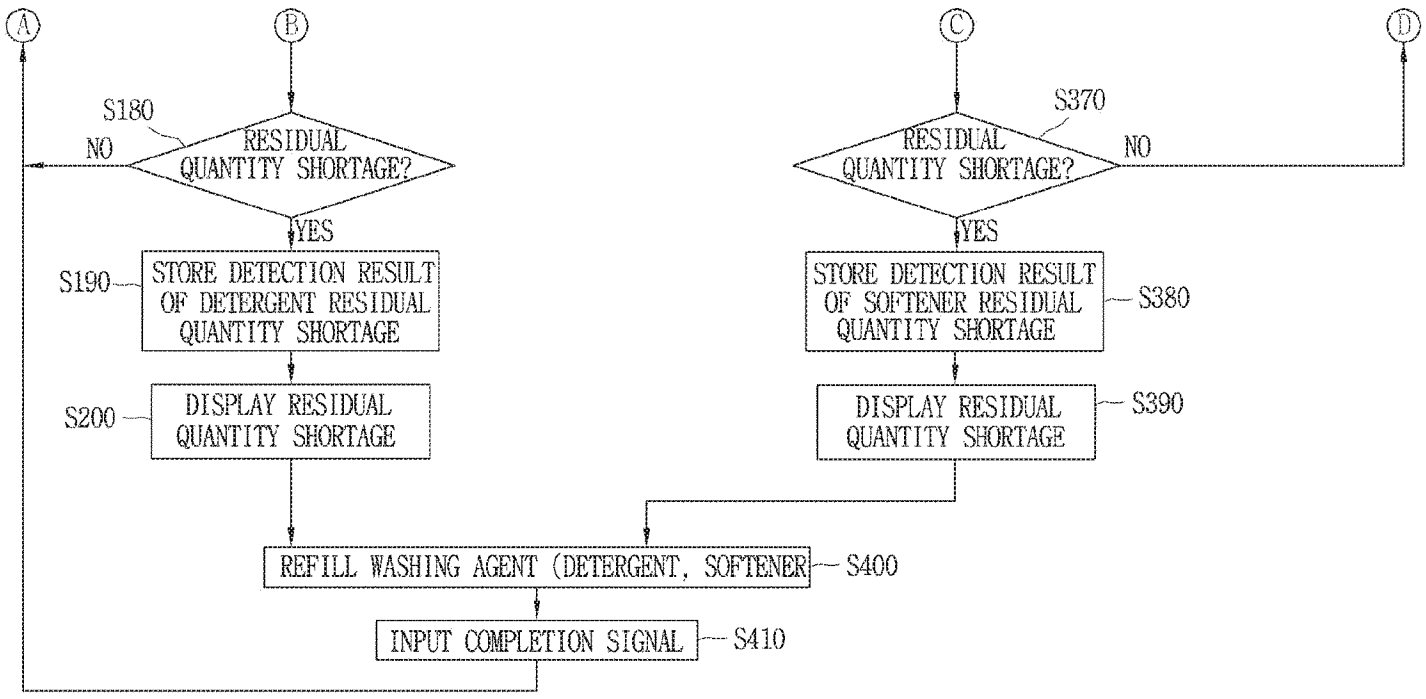

Hereinafter, a method for supplying a washing agent of a laundry treating apparatus in accordance with one embodiment of the present disclosure will be described with reference to FIGS. 11A and 11B.

When an operation signal is input, the controller 310 may control the laundry quantity detecting unit 315 to detect a quantity of laundry within the rotary tub 160, in step S110.

When a washing stroke is started, in step S120, the controller 310 may control the water supply unit 330 to supply washing water corresponding to the detected quantity of the laundry into the tub 120, in step S130.

In step S140, the controller 310 may check through the data storage unit 320 whether or not a liquid detergent supply is an initial supply after detecting a residual quantity shortage by the residual detergent detecting portion 251*a*.

When the liquid detergent supply is the initial supply after the detection of the residual quantity shortage, the controller 310 may control the calculating unit 325 to calculate a third quantity value by adding a first quantity value as a quantity of liquid detergent corresponding to the quantity of the laundry with a second quantity value corresponding to the detergent supply passage 191*a*, and determine the third quantity value as a detergent supply quantity, in step S150.

When the liquid detergent supply is not the initial supply after the detection of the residual quantity shortage, in step S140, the controller 310 may determine the first quantity value corresponding to the quantity of the laundry detected by the laundry quantity detecting unit 315 as the detergent supply quantity, in step S155.

The controller 310 may control an operation (operation time) of the washing agent supply unit 170 (actually the detergent pump 211*a*) to supply an amount of liquid detergent corresponding to the decided supply quantity, in step S160. When the detergent supply is completed, the controller 310 may control the residual quantity detecting unit 250 (e.g., the residual detergent detecting portion 251*a*) to detect a residual quantity of the detergent, in step S170.

When a residual quantity shortage is detected by the residual detergent detecting portion 251*a*, in step S180, the controller 310 may control the data storage unit 320 to store the residual quantity shortage detection result, in step S190.

When expected strokes are completed after the residual quantity shortage detection result is stored, the controller 310 may control the display unit 340 to externally output the detected residual quantity shortage of the detergent, in step S200. In one embodiment, when the washing stroke, a rinsing stroke and a succeeding stroke are all completed, the controller 310 may control the display unit 340 to output the residual quantity of the detergent or softener.

Meanwhile, when the rinsing stroke is started, in step S310, the controller 310 may control the water supply unit 330 to supply washing water, in step S320. Here, when a stroke to be started is not the rinsing stroke, in step S310, the controller 310 may control the succeeding stroke to be executed, in step S315.

The controller 310 may check whether or not a softener supply is an initial supply after detecting a residual quantity shortage of the liquid softener through the data storage unit 320, during the supply of the washing water, in step S330.

When the softener supply is the initial supply after the detection of the residual quantity shortage of the liquid softener, the controller 310 may control the calculate portion 325 to calculate a third quantity value by adding a first quantity value as a quantity of the softener corresponding to the laundry quantity detected by the laundry quantity detecting unit 315 with a second quantity value as a quantity of the liquid softener corresponding to the softener supply passage 191*b*, and decides the third quantity value as a supply quantity of the liquid softener, in step S340.

When the softener supply is not the initial supply after the detection of the residual quantity shortage of the liquid softener, in step S330, the controller 310 may determine the first quantity value corresponding to the quantity of the laundry detected by the laundry quantity detecting unit 315 as the supply quantity of the liquid softener, in step S345.

When the supply quantity of the liquid softener has been determined, the controller 310 may control the softener supply portion (e.g., the softener pump 211*b*) to supply the determined amount of the liquid softener, in step S350. When the supply of the liquid softener has completed, the controller 310 may control the residual softener detecting portion 251*b* to detect the residual quantity of the softener, in step S360.

When the residual quantity shortage of the softener is detected, the controller 310 may control the data storage unit 320 to store the detection result of the residual quantity shortage, in step S380. The controller 310 may then control the display unit 340 to externally output the residual quantity shortage of the softener, in step S390.

Meanwhile, when the residual quantity shortage of the washing agent (detergent and softener) is externally output through the display unit 340, the cover 230 may be opened to pull out the storage container 180. Each injection opening cover 185*a*, 185*b* of the detergent or softener of the storage container 180 may then be open, so as to refill the detergent or softener in the storage container 180.

When the refill of the detergent or softener is completed, the storage container 180 may be inserted into the storage container accommodating portion 240 through the draw-out opening 222 of the frame 220. Meanwhile, the laundry treating apparatus according to this embodiment can input a refill completion signal through the signal input unit 350 when the storage container 180 is accommodated in the storage container accommodating portion 240 after the refill of the washing agent, in step S410.

As described above, a laundry treating apparatus according to one embodiment of the present disclosure may include a controller that controls a washing agent supply unit to further supply a quantity of liquid washing agent corresponding to a washing agent supply passage in addition to a quantity of liquid washing agent corresponding to a detected quantity of laundry, when a liquid washing agent is initially supplied into a tub after detecting a residual quantity shortage of the liquid washing agent, thereby accurately supplying an appropriate quantity of liquid washing agent, irrespective of a residual quantity of the liquid washing agent.

Also, a residual quantity detecting unit that detects a residual quantity of liquid washing agent may be disposed in a liquid washing agent supply passage, separate from a storage container. This may facilitate a movement of the storage container of the liquid washing agent, and thus, allow the storage container to be drawn out of a cabinet, which may result in facilitating filling of the liquid washing agent into the storage container of the liquid washing agent. Moreover, as the storage container of the liquid washing agent can be drawn out of the cabinet, an inside of the storage container may more easily be cleaned.

A preventing portion may be provided which is interposed between an introduction part and an electrode. The preventing portion may prevent direct contact between the liquid washing agent introduced through the introduction part and the electrode, thereby improving detection reliability with respect to the residual quantity of the liquid washing agent.

A connector connecting portion of a residual detergent detecting portion and a connector connecting portion of a residual softener detecting portion may be spaced apart from each other in up and down directions, thereby facilitating connection and separation of each connector.

The connector connecting portion of the residual detergent detecting portion and the connector connecting portion of the residual softener detecting portion may be disposed in an intersecting direction with (e.g., perpendicular to) introduction parts and discharge parts. This may result in preventing interference between connectors and the introduction parts and the discharge parts upon connecting and separating the connectors, and interference with the connectors upon connecting pipes of the introduction parts and the discharge parts.

Therefore, an aspect of the detailed description is to provide a laundry treating apparatus capable of accurately supplying a washing agent, irrespective of a residual quantity of a washing agent within a storage container, and a method for supplying a washing agent thereof.

Another aspect of the detailed description is to provide a laundry treating apparatus capable of installing a storage container of a washing agent and a residual quantity detecting unit in a separate manner, and a method for supplying a washing agent thereof.

Another aspect of the detailed description is to provide a laundry treating apparatus capable of facilitating an injection of a washing agent by allowing a storage container of the washing agent to be drawn out of a cabinet, and a method for supplying a washing agent thereof.

To achieve these and other advantages and in accordance with the purpose of this specification, as embodied and broadly described herein, there is provided a laundry treating apparatus which may include a cabinet, a tub disposed within the cabinet, a rotary tub provided within the tub in a rotatable manner, and a washing agent supply unit to supply a liquid washing agent including liquid detergent or liquid softener (softening agent) into the tub. The washing agent supply unit may be provided with a storage container that stores the liquid washing agent therein and configured to be drawn out of the cabinet. A washing agent supply passage may be formed between the storage container and the tub. A pump may be provided in the washing agent supply passage. A residual quantity detecting unit may be provided in the washing agent supply passage to detect a residual quantity of the liquid washing agent. A laundry quantity detecting unit may be provided to detect a quantity of the laundry within the rotary tub. Moreover, a controller may be provided to control the washing agent supply unit to supply the liquid washing agent by adding a quantity of the liquid washing agent corresponding to the washing agent supply passage with a quantity of the liquid washing agent corresponding to the quantity of the laundry detected by the laundry quantity detecting unit, when the liquid washing agent is initially supplied into the tub after detecting a residual quantity shortage of the liquid washing agent through the residual quantity detecting unit.

The residual quantity detecting unit may include cases that define internal hermetic spaces, introduction parts disposed on one side of each of the cases to communicate with the hermetic spaces, discharge parts communicating with the hermetic spaces, and electrodes downwardly extending within the hermetic space.

Each of the electrodes may include a first electrode and a second electrode spaced apart from each other, and each of the introduction parts may protrude from one side of the corresponding case along a spaced direction of the first electrode and the second electrode.

Each of the cases may be provided with a preventing portion interposed between the introduction part and the electrode to prevent the liquid washing agent, introduced through the introduction part, from being brought into contact with the electrode. The preventing portion may downwardly extend from a bottom of the introduction part by a length 1.5 to 3 times greater than a flow cross-sectional area of the introduction part.

The washing agent supply unit may include a detergent supply portion supplying the detergent into the tub. The washing agent supply unit may include a softener supply portion supplying the softener into the tub.

The residual quantity detecting unit may include a residual detergent detecting portion that detects a residual quantity of the detergent, and a residual softener detecting portion that detects a residual quantity of the softener.

A connector connecting portion that enables a connector to be connected to the electrodes of the residual detergent detecting portion may be provided on an upper end of the residual detergent detecting portion. Moreover, a connector connecting portion that enables a connector to be connected to the electrodes of the residual softener detecting portion may be provided on an upper end of the residual softener detecting portion.

The connector connecting portion of the residual detergent detecting portion and the connector connecting portion of the residual softener detecting portion may be spaced apart from each other in up and down directions. The connector connecting portion of the residual softener detecting portion may be located higher than the connector connecting portion of the residual detergent detecting portion. The discharge part of the residual softener detecting portion may be located higher than the discharge part of the residual detergent detecting portion.

A detergent guide portion to guide an internal detergent toward the discharge part may be provided at a lower portion of the residual detergent detecting portion. A softener guide portion to guide an internal softener toward the discharge part may be provided at a lower portion of the residual softener detecting portion.

The laundry treating apparatus may further include a circulation passage through which water of the tub flows into the tub via an outside. The washing agent supply passage may be connected to the circulation passage.

The washing agent supply passage may be provided with a liquid detergent supply passage through which the liquid detergent is supplied, and a liquid softener supply passage through which the liquid softener is supplied.

The controller may include a data storage unit to store therein a first quantity value of the liquid washing agent set to correspond to the quantity of the laundry detected by the laundry quantity detecting unit, and a second quantity value of the liquid washing agent set to correspond to the washing agent supply passage.

The controller may include a calculating unit to calculate a third quantity value by adding the first quantity value and the second quantity value with each other. The controller may decide the first quantity value as a supply quantity of the liquid washing agent when a supply of the liquid washing agent is not an initial supply after detecting the residual quantity shortage of the liquid washing agent.

The controller may control the residual quantity detecting unit to detect the residual quantity of the liquid washing agent after the supply of the liquid washing agent, and control the data storage unit to store a detection result of the residual quantity shortage. In one embodiment, the controller may control the residual quantity detecting unit to detect the residual quantity of the liquid washing agent after the supply of the liquid washing agent, and control the data storage unit to store the detection result of the residual quantity shortage and externally output the detection result, when the residual quantity shortage is detected.

To achieve these and other advantages and in accordance with the purpose of this specification, as embodied and broadly described herein, there is provided a method for supplying a washing agent of a laundry treating apparatus comprising a cabinet, a tub disposed within the cabinet, a rotary tub provided within the tub in a rotatable manner, a washing agent supply unit to supply a liquid washing agent including liquid detergent and liquid or softener into the tub, the washing agent supply unit provided with a storage container storing the liquid washing agent and drawn out of the cabinet, a washing agent supply passage formed between the storage container and the tub, and a pump provided in the washing agent supply passage, a residual quantity detecting unit provided at a discharge side of the pump of the washing agent supply passage to detect a residual quantity of the liquid washing agent, and a laundry quantity detecting unit to detect a quantity of the laundry within the rotary tub, the method including detecting the quantity of the laundry accommodated in the rotary tub, checking whether or not a supply of the liquid washing agent is an initial supply after detecting a residual quantity shortage of the liquid washing agent, calculating a supply quantity of the liquid washing agent by adding a quantity of the liquid washing agent corresponding to the washing agent supply passage with a quantity of the liquid washing agent corresponding to the detected laundry quantity, when the supply of the liquid washing agent is the initial supply after detecting the residual quantity shortage of the liquid washing agent, and supplying the liquid washing agent to correspond to the calculated supply quantity of the liquid washing agent.

The method may further include supplying water into the tub before supplying the liquid washing agent. The calculating the supply quantity of the liquid washing agent may be configured to decide the quantity corresponding to the detected laundry quantity as the supply quantity of the liquid washing agent when the supply of the liquid washing agent is not the initial supply after detecting the residual quantity shortage of the liquid washing agent.

The method may further include detecting the residual quantity of the liquid washing agent after supplying the liquid washing agent, and storing a detection result of the residual quantity shortage when the residual quantity shortage of the liquid washing agent is detected according to the detection result of the residual quantity of the liquid washing agent. The method may further include externally outputting the detection result of the residual quantity shortage. Moreover, the method may further include refilling the liquid washing agent by drawing out the storage container after detecting the residual quantity of the liquid washing agent.

According to another aspect of the present disclosure, a laundry treating apparatus may include a cabinet, a tub provided within the cabinet, a rotary tub provided in the tub in a rotatable manner, a washing agent supply unit to supply a liquid washing agent including detergent or softener, the washing agent supply unit provided with a storage container storing the liquid washing agent therein and drawn out of the cabinet, a washing agent supply passage formed between the storage container and the tub, and a pump provided in the washing agent supply passage, and a residual quantity detecting unit provided in the washing agent supply passage to detect the residual quantity of the liquid washing agent.

With this configuration, the storage container storing the liquid washing agent can be drawn out of the cabinet, which may facilitate an injection or filling of the liquid washing agent in the storage container.

Meanwhile, according to another aspect of the present disclosure, a residual quantity detecting unit for a liquid washing agent may include cases defining internal hermetic spaces, introduction parts provided on one side of each of the case to communicate with the hermetic spaces, discharge parts communicating with the hermetic spaces, first and second electrodes downwardly extending within the hermetic spaces, and preventing portions disposed between the introduction parts and the electrodes within the cases to prevent a direct contact between the liquid washing agent, introduced through the introduction parts, and the electrodes.

With the configuration, the electrode to detect the residual quantity of the liquid washing agent can be installed in a liquid washing agent supply passage, in a manner of being separated from the storage container, thereby facilitating a movement of the storage container of the liquid washing agent.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a cabinet;

a tub disposed within the cabinet;

a rotary tub provided within the tub in a rotatable manner;

a washing agent supply unit to supply a liquid washing agent including liquid detergent or liquid softener into the tub, the washing agent supply unit provided with a storage container that stores the liquid washing agent and coupled to the cabinet to be drawn out of the cabinet, a washing agent supply passage formed between the storage container and the tub, and a pump provided in the washing agent supply passage;

a residual quantity detecting unit provided in the washing agent supply passage that detects a residual quantity of the liquid washing agent;

a laundry quantity detecting unit that detects a quantity of the laundry within the rotary tub; and a controller configured to detect a residual quantity shortage of the liquid washing agent through the residual quantity detecting unit, to determine the liquid washing agent is an initial supply after detecting the residual quantity shortage, and to control the washing agent supply unit to supply the liquid washing agent by adding a quantity of the liquid washing agent corresponding to the washing agent supply passage with a quantity of the liquid washing agent corresponding to the quantity of the laundry detected by the laundry quantity detecting unit, wherein the residual quantity detecting includes a case that internal hermetic spaces, introduction ports disposed on one side of the case in communication with the hermetic spaces, electrodes that extend down into each hermetic space, and a baffle positioned between each of the introduction ports and the electrodes, and wherein the baffle extends downward past a bottom of the introduction ports by a length of 1.5 to 3 times greater than a flow cross-sectional area of the introduction ports.

2. The apparatus of claim 1, wherein the residual quantity detecting unit further includes discharge ports in communication with the hermetic spaces.

3. The apparatus of claim 1, wherein the electrodes includes a first electrode and a second electrode spaced apart from each other, and wherein one of the introduction ports protrudes from the side of the case in a direction along a direction in which the First electrode and the second electrode are arranged.

4. The apparatus of claim 2, wherein the baffle prevents a flow of the liquid washing agent, introduced through the introduction ports, from making direct contact with the electrodes.

5. The apparatus of claim 2, wherein the washing agent supply unit includes a detergent supply portion that supplies the detergent into the tub, and a softener supply portion that supplies the softener into the tub, and wherein the residual quantity detecting unit includes a residual detergent detecting portion that detects a residual quantity of the detergent, and a residual softener detecting portion that detects a residual quantity of the softener.

6. The apparatus of claim 5, wherein connector connecting portions to couple with connectors to be connected to the electrodes of the residual detergent detecting portion and the residual softener detecting portion, respectively, are provided on upper ends of the residual detergent detecting portion and the residual softener detecting portion, respectively.

7. The apparatus of claim 6, wherein the connector connecting portion of the residual detergent detecting portion and the connector connecting portion of the residual softener detecting portion are vertically spaced apart from each other.

8. The apparatus of claim 7, wherein the connector connecting portion of the residual softener detecting portion is provided higher than the connector connecting portion of the residual detergent detecting portion, and wherein the discharge port of the residual softener detecting portion is provided higher than the discharge port of the residual detergent detecting portion.

9. The apparatus of claim 5, wherein a detergent guide surface that guides detergent toward the discharge port for the detergent is provided at a lower portion of a cavity in the residual detergent detecting portion, and wherein a softener guide surface that guides the liquid softener toward the discharge port for the softener is provided at a lower portion of a cavity in the residual softener detecting portion.

10. The apparatus of claim 1, further comprising a circulation passage through which water of the tub flows into the tub, wherein the washing agent supply passage is connected to the circulation passage.

11. The apparatus of claim 1, wherein the controller includes:

a data storage unit to store a first quantity value of the liquid washing agent set to correspond to the quantity of the laundry detected by the laundry quantity detecting unit, and a second quantity value of the liquid washing agent set to correspond to the washing agent supply passage; and a calculating unit to calculate a third quantity value by adding the first quantity value and the second quantity value with each other.

12. The apparatus of claim 11, wherein the controller is configured to determine the first quantity value as a supply quantity of the liquid washing agent when a supply of the liquid washing agent is not an initial supply after detecting the residual quantity shortage of the liquid washing agent.

13. The apparatus of claim 11, wherein the controller is configured to detect the residual quantity of the liquid washing agent through the residual quantity detecting unit after the supply of the liquid washing agent, and to store a flag of the residual quantity shortage or store the flag of the residual quantity shortage and externally output the flag of the residual quantity shortage, when the residual quantity shortage is detected by the residual quantity detecting unit.

* * * * *